US006375131B1

(12) United States Patent
Youst

(10) Patent No.: US 6,375,131 B1
(45) Date of Patent: Apr. 23, 2002

(54) PLASTIC GROCERY BAG HOLDER

(76) Inventor: Donald R. Youst, 2012 Mississippi, Joplin, MO (US) 64804

( * ) Notice: Subject to any disclaimer, the term of this patent is extended or adjusted under 35 U.S.C. 154(b) by 0 days.

(21) Appl. No.: 09/716,587

(22) Filed: Nov. 20, 2000

Related U.S. Application Data

(63) Continuation-in-part of application No. 09/070,172, filed on Apr. 30, 1998, now abandoned.

(51) Int. Cl.[7] ..... B65B 67/04
(52) U.S. Cl. ..... 248/101; 248/99
(58) Field of Search ..... 248/95, 97, 99, 248/100, 101

(56) References Cited

U.S. PATENT DOCUMENTS

| | | | | | |
|---|---|---|---|---|---|
| 2,754,076 | A | * | 7/1956 | Westervelt | 248/97 |
| 4,407,474 | A | | 10/1983 | Swenson | 248/97 |
| 4,437,634 | A | | 3/1984 | Hambleton | 248/97 |
| 4,867,339 | A | * | 9/1989 | Hahn | 220/404 |
| 4,930,734 | A | | 6/1990 | Schmidt | 248/97 |
| 5,261,553 | A | * | 11/1993 | Mueller et al. | 220/404 |
| 5,671,861 | A | * | 9/1997 | Hall et al. | 220/404 |
| D401,719 | S | * | 11/1998 | Van Leeuwen et al. | D34/1 |

* cited by examiner

*Primary Examiner*—Leslie A. Braun
*Assistant Examiner*—Gwendolyn Baxter
(74) *Attorney, Agent, or Firm*—Smith, Danamraj & Youst, P.C.; Lawrence R. Youst

(57) ABSTRACT

An apparatus (410) for holding a plastic bag (36) in an upright and open position comprising a base (412), an upper frame (414), a vertical support member (416) and a pair of handle receiving members (418, 420) rotatably mounted to the upper frame (414) is disclosed. The handle receiving members (418, 420) each include a pair of rotatable arms (422, 424, 426, 428). The rotatable arms (422, 424, 426, 428) having a first position and a second position. In the first position, the rotatable arms (422, 424, 426, 428) are generally vertical for receiving and removing the plastic bag (36). In the second position, the rotatable arms (422, 424, 426, 428) are rotated a predetermined angle from vertical. The rotation of the rotatable arms (422, 424, 426, 428) from the first to the second position increases the distance between the rotatable arms (422, 424, 426, 428) in each pair of handle receiving members (418, 420), thereby securing the plastic bag (36) in an upright and open position within the apparatus (410).

14 Claims, 3 Drawing Sheets

PLASTIC GROCERY BAG HOLDER

CROSS-REFERENCE

This application is a continuation-in-part of application Ser. No. 09/070,172 filed Apr. 30, 1998, now abandoned.

TECHNICAL FIELD OF THE INVENTION

This invention relates, in general, to an article for holding flexible sacks and more particularly, to an article for holding in an upright and open position, a grocery bag of the type made from a flexible plastic film.

BACKGROUND OF THE INVENTION

Without limiting the scope of the invention, its background is described in connection with plastic grocery bags, as an example.

Heretofore, in this field, grocery stores, as well as other retail stores, have packed goods purchased by the shopper in paper bags. Paper bags provided a convenient means for carrying groceries directly to the shopper's residence, or vehicle for the trip home. Once the groceries were unloaded from the paper bags, the bags were useful as receptacles for accumulating garbage and other refuse, prior to disposal of the refuse. For this purpose, the bags were used either standing alone, or inserted as liners into waste containers.

In relatively recent times, the paper grocery bag has begun to be replaced by bags made of a flexible plastic film. Plastic bags have been touted by large supermarkets and similar retail stores as being the wave of the future, and a great convenience to shoppers. It has been found, however, that some shoppers have disagreed with that assessment, on the grounds that plastic bags are not bio-degradable and that the plastic bags will not remain in an upright position in their cars. Nonetheless, when the relative merits of paper bags versus plastic bags are weighed, it seems clear that economic considerations apparently dictate that plastic bags will be dispensed with increasing frequency by stores. It has also been found that plastic grocery bags by themselves are not practically useable as trash receptacles, in that they collapse into a limp pile when placed unsupported on the floor.

Several prior attempts have been made to design a holder for plastic grocery bags such as those describe in U.S. Pat. No. 4,930,734 to Schmidt (the '734 patent), U.S. Pat. No. 4,407,474 to Swenson (the '474 patent) and U.S. Pat. No. 4,437,634 to Hambleton (the '634 patent). The '734 patent discloses a plastic grocery bag holder including a pair of thin, uniform cross-section end panels and at least one pair of thin, uniform cross-section side rails. A cutout in the upper portion of each end panel has one or more downwardly projecting tabs for receiving each handle loop of a flexible plastic bag such that the bag may be retained in an open, upright position within the holder.

The '474 patent is directed to a plastic grocery bag holder having a body portion terminating in a base and a pair of integral handles. The holder includes a horizontally disposed base member, a pair of oppositely-disposed, upwardly-projecting side wall members, each of which is attached at its lower end to the base member, an upwardly projecting rear wall member, wherein each vertical edge of the rear wall member is attached to a vertical edge of each of the side wall members and pair of spaced-apart ears projecting above the upper edges of each of the side wall members, wherein the space between the ears extends downwardly into each of the side wall members.

The '634 patent is directed to a plastic grocery bag holder having a pair of integral handles and a body portion terminating in a base portion. The holder has a horizontally disposed base member, a pair of oppositely-disposed, upwardly-projecting side wall members, which are attached at their lower ends to the base member, an upwardly projecting rear wall member, wherein each vertical edge of the rear wall member is attached to a vertical edge of each of the side wall members and a pair of spaced apart protuberances that are affixed to the outer side, and near the upper edge, of each of the side wall members.

Each of the above described plastic grocery bag holders, however, suffers from the same shortcomings specifically, the need to stretch the handles of the plastic bag around tabs, ears or protuberances in order to obtain a secure attachment to the holder. As such, the use of these plastic grocery bag holders requires a high degree of dexterity.

Therefore, a need has arisen for an improved article for holding in an upright and open position, a grocery bag of the type made from a flexible plastic film. A need has also arisen for such a holder that allows for the easy placement and removal of the plastic grocery bag on the holder without the need to stretch the handles of the plastic bag around tabs, ears or protuberances to maintaining the plastic bag securely within the holder.

SUMMARY OF THE INVENTION

The present invention disclosed herein comprises an article for holding in an upright and open position, a grocery bag of the type made from a flexible plastic film. The plastic grocery bag holder of the present invention allows for easy placement and removal of the plastic grocery bag on the holder without the need to stretch the handles of the plastic bag around tabs, ears or protuberances to maintaining the plastic bag securely within the holder.

The plastic grocery bag holder of the present invention comprises a base, an upper frame, a vertical support member extending between the base and the upper frame member and a pair of handle receiving members. The handle receiving members are rotatably mounted to the upper frame member for disposition within the handles of the plastic bag. The base of the holder may be formed by the bottom surface of the vertical support members, a base frame, or may be a horizontally disposed bottom wall. The vertical support member may be a pair of side walls, a front wall and a rear wall or may be two pair of generally symmetrically arranged legs.

Each rotatable handle receiving member includes a pair of rotatable arms that may operate together or independently of one another. The arms have two operating positions. First, the arms may be placed in a generally vertical position for receiving and removing the plastic bag from the holder. Second, the arms may be rotated a predetermined angle from vertical for securing the plastic bag within the holder. In addition, the rotation of the arms creates translational movement of the arms such that the distance between the arms in each pair of arms is greater in the second position than in the first position. As such, the bag may be placed in the holder without stretching the handles of the bag. The rotation and associated translation of the arm then stretches the handles of the bag, thereby holding the plastic bag in an upright and open position.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
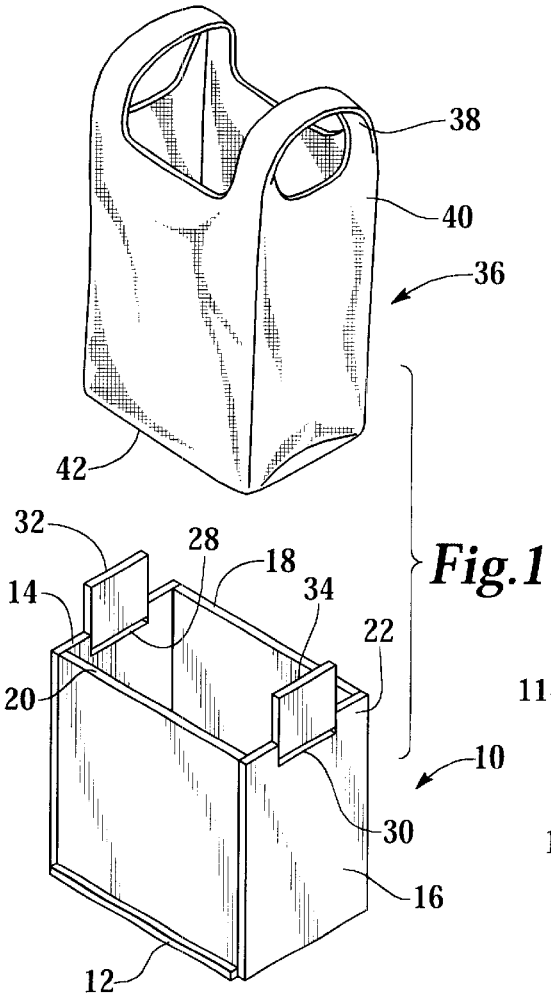
FIG. 1 is a plan view of one embodiment of a plastic grocery bag holder of the present invention and a plastic grocery bag to be disposed therein.

Referring to FIG. 1, an improved holder for flexible bags or sacks such as grocery bags made from plastic film that is adaptable to maintain the bag in an upright position with the mouth of the bag open making the bag useful as a trash receptacle is depicted and generally designated 10. Holder 10 has a horizontally disposed base member or bottom wall 12. Holder 10 also has a pair of oppositely disposed upwardly projecting side walls 14, 16 which are attached at their lower ends to bottom wall 12. Holder 10 has an upwardly projecting rear wall 18, wherein each vertical edge of rear wall 18 is attached to a vertical edge of each of the side walls 14, 16. The lower end of rear wall 18 is attached to bottom wall 12. Holder 10 also includes an upwardly projecting front wall 20, wherein each vertical edge of front wall 20 is attached to a vertical edge of each of the side wall members 14, 16. Front wall 20 is attached to bottom wall 12 at its lower end.

The upper ends of side walls 14, 16, rear wall 18 and front wall 20 may be considered the upper frame 22 of holder 10. Upper frame 22 includes a pair of rods (not shown) that respectively extend between the sides of recess 28 of side wall 14 and recess 30 of side wall 16. Rotatably mounted on one rod is handle receiving member 32. Rotatably mounted on the other rod is handle receiving member 34.

A plastic bag 36 that is suitable for use with holder 10 of the present invention is also illustrated in FIG. 1. Plastic bag 36 consists of a pair of integral handles 38 and a body portion 40 terminating in a base portion 42. In the trade, it is known as a "T-shirt sack," in view of its configuration. Preferably, plastic bag 36 is formed from a gusseted, flattened tube of thermoplastic material, such as polyethylene. Thus, handles 38 are also gusseted, and this provides a double thickness handle for strength. Although plastic bags such as plastic bag 36 are manufactured in a variety of sizes, the typical size for plastic bag 36, when it serves as a grocery sack, is designated as ⅙th of a barrel.

As should be apparent to those skilled in the art, holder 10 of the present invention may be manufactured in any size to fit the particular size of plastic bag 36. In addition, holder 10 of the present invention may be constructed from any suitably rigid material, such as plastic, metal, wood, heavy cardboard or the like.

Figure 2:
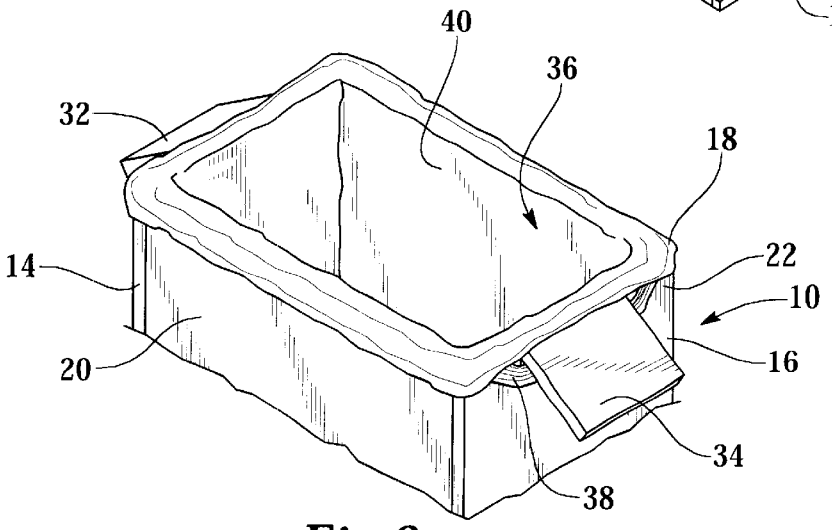
FIG. 2 is a partial cut away view of the holder of FIG. 1 with a plastic bag secured therein.

The typical usage of holder 10 is to receive plastic bag 36 therein with handles 38 of plastic bag 36 being placed around handle receiving members 32, 34. Handle receiving members 32, 34 will be in their generally upwardly extending position for receiving handles 38 of plastic bag 36. Once plastic 36 has been placed within holder 10, handle receiving members 32, 34 may then be rotated a predetermined angle from vertical for securing plastic bag 36 in place, as best seen in FIG. 2. Sufficient resistence should exist against the rotation of handle receiving members 32, 34 such that handle receiving members 32, 34 will not rotate unless the user of holder 10 desires such rotation for the removal of plastic bag 36. Alternatively, a locking mechanism (not shown) may be included to prevent such rotation.

Once plastic bag 36 has been filled with garbage or other refuse, or when the user of holder 10 desires to remove plastic bag 36 from holder 10, handle receiving members 32, 34 are simply returned to their generally vertical position such that plastic bag 36 may be easily removed from holder 10. In this position, a new plastic bag 36 may be placed within holder 10 and again secured in place by rotating handle receiving members 32, 34 through a predetermined angle from vertical.

Figure 3:
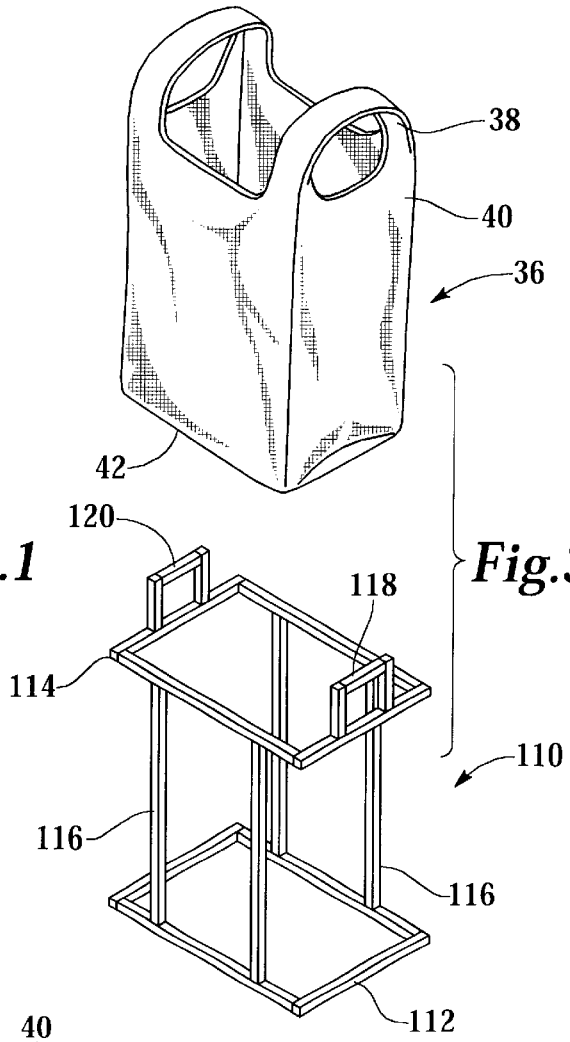
FIG. 3 is a plan view of another embodiment of a plastic grocery bag holder of the present invention and a plastic grocery bag to be disposed therein.

Referring now to FIG. 3, another embodiment of a holder for receiving a grocery bag and maintaining the bag in an upright open position is depicted and generally designated 110. Holder 110 includes a base frame 112 and an upper frame 114. Holder 110 includes four upwardly projecting support members 116 that extend between base frame 112 and upper frame 114 to support upper frame 114. Rotatably positioned upon upper frame 114 is a pair of handle receiving members 118, 120. Handle receiving members 118, 120 are rotatable between a vertical position, for receiving plastic bag 36 into and removing plastic bag 36 from holder 110, and a position wherein handle receiving members 118, 120 are rotated a predetermined angle from vertical to secure plastic bag 36 within holder 110 as described above with reference to FIG. 2.

Figure 4:
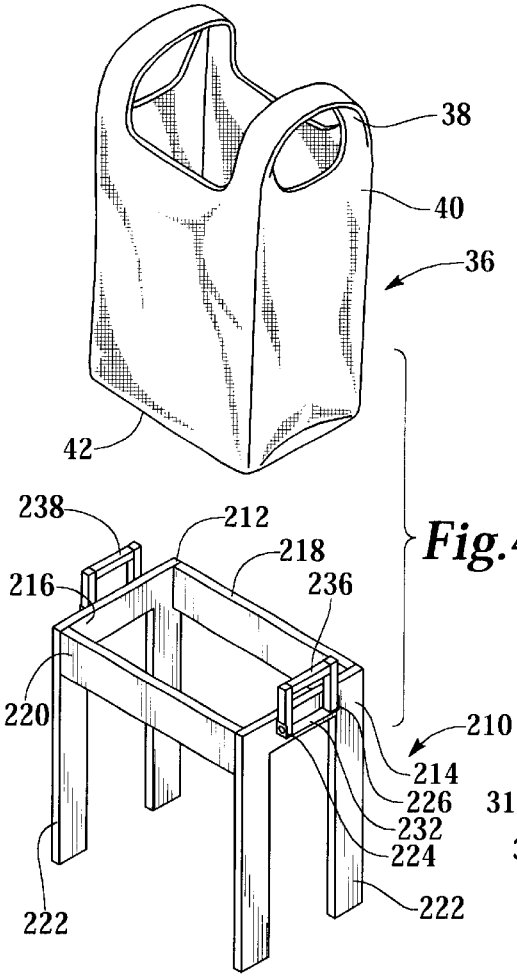
FIG. 4 is a plan view of another embodiment of a plastic grocery bag holder of the present invention and a plastic grocery bag to be disposed therein.

In FIG. 4, another embodiment of a holder for supporting a plastic bag in an upright and open position is depicted and generally designated 210. Holder 210 includes an upper frame 212 that consists of a pair of side panels 214, 216, a rear panel 218 and a front panel 220. Rear panel 218 is attached to side panels 214, 216 at their respective vertical edges. Similarly, front panel front 220 is attached to side panels 214, 216 at their respective vertical edges. Holder 210 also includes four upwardly projecting legs 222 that attach to the lower horizontal edge of side panels 214, 216. The lower surfaces of legs 224 provide a base for holder 210. Even though legs 222 are depicted as extending from side panels 214, 216, it should be understood by one skilled in the art that legs 222 may alternatively extend from front panel 220 and rear panel 218.

Upper frame 212 includes a pair of tabs 224, 226 outwardly extending from side panel 214 and a similar pair of tabs outwardly extending from side panel 216 (not pictured). Extending between tabs 224 and 226 is rod 232. Handle receiving member 236 is rotatably mounted on rod 232. Similarly, a rod extends between the tabs of side panel 216 such that handle receiving member 238 is rotatable thereabout. Handle receiving members 236, 238 operate in the manner as described with reference to FIG. 1 and handle receiving members 32, 34. Specifically, handle receiving members 236, 238 receive handles 38 of plastic bag 36 as plastic bag 36 is placed within holder 210. Handle receiving members 236, 238 are then rotated to secure handles 38 in place such that plastic bag 36 is secured within holder 212 to receive garbage or other refuse. Once plastic bag 36 is full or the user of holder 210 wants to remove plastic bag 36 from holder 210, handle receiving members 236, 238 are returned to a vertical position such that plastic bag 36 may easily be removed from holder 210.

Figure 5:
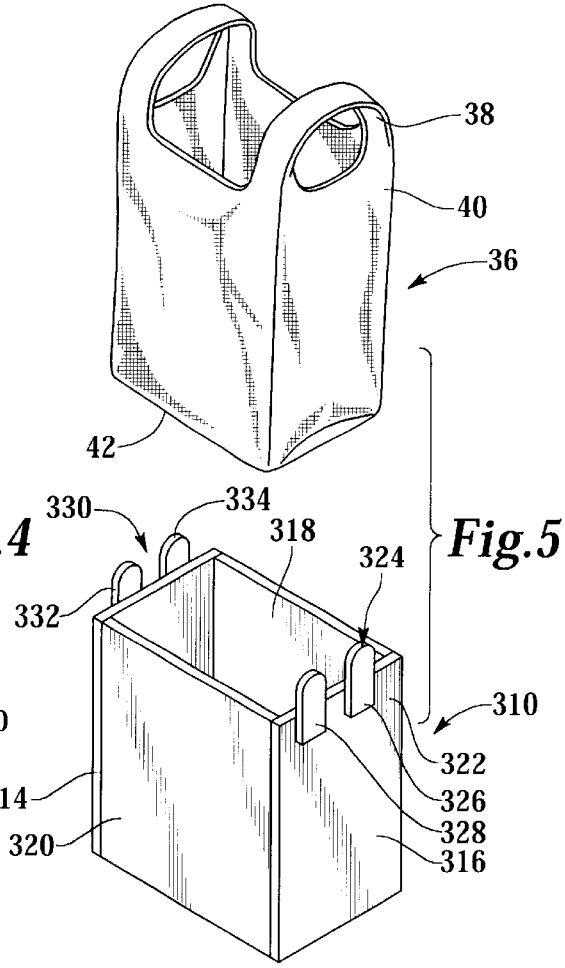
FIG. 5 is a plan view of another embodiment of a plastic grocery bag holder of the present invention and a plastic grocery bag to be disposed therein.

Referring next to FIG. 5, another embodiment of a holder for securing a plastic bag in an upright and open position is depicted in generally designated 310. Holder 310 includes a bottom wall 312 and a pair of oppositely disposed upwardly projecting side walls 314, 316 that are attached at their lower ends to bottom wall 312. Holder 310 includes an upwardly projecting rear wall 318, wherein each vertical edge of rear wall 318 is attached to a vertical edge of each of the side walls 314, 318. Holder 310 also includes an upwardly projecting front wall 320, wherein each vertical edge of front wall 320 is attached to a vertical edge of each of the side walls 314, 316. Rear wall 318 and front wall 320 are attached at their lower ends to bottom wall 312. The upper ends of side walls 314, 316, rear wall 318 and front wall 320 may be considered the upper frame 322 of holder 310. Outwardly extending from upper frame 322 at side wall 314 is handle receiving member 324 that consists of rotatable arms 326, 328. Similarly, outwardly extending from side wall 316 is handle receiving member 330 which consists of rotatable arms 332, 334.

Figure 6:
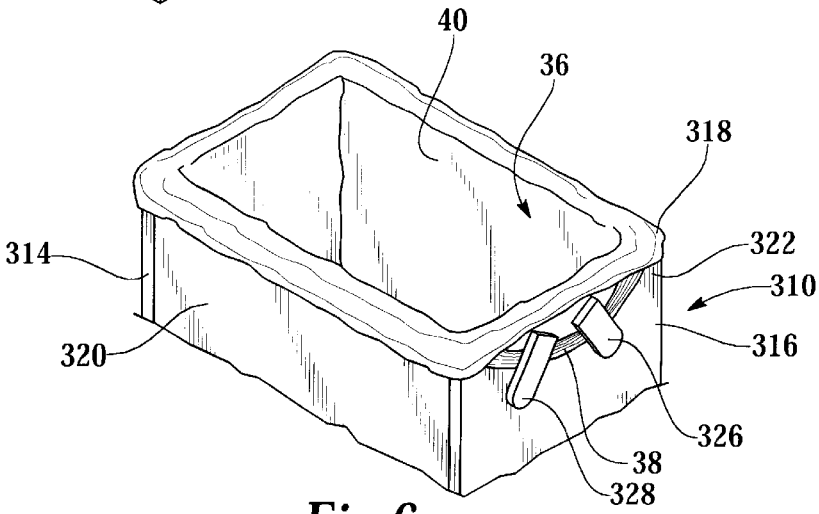
FIG. 6 is a partial cut away view of the holder of FIG. 5 with a plastic bag secured therein.

Holder 310 receives plastic bag 36 such that handles 38 are disposed about handle receiving members 324, 330 when arms 326, 328, 332, 334 are in their vertical position. Once plastic bag 36 is in place within holder 310, arms 326, 328 of handle receiving member 324 and arms 332, 334 of handle receiving member 330 are rotated to secure plastic bag 36 within holder 310 as best seen in FIG. 6. When the user of holder 310 desires to remove plastic bag 36 from holder 310, arms 326, 328 of handle receiving member 324 and arms 332, 334 of handle receiving member 330 are returned to their vertical position such that plastic bag 36 may easily be removed from holder 310.

Figure 7:
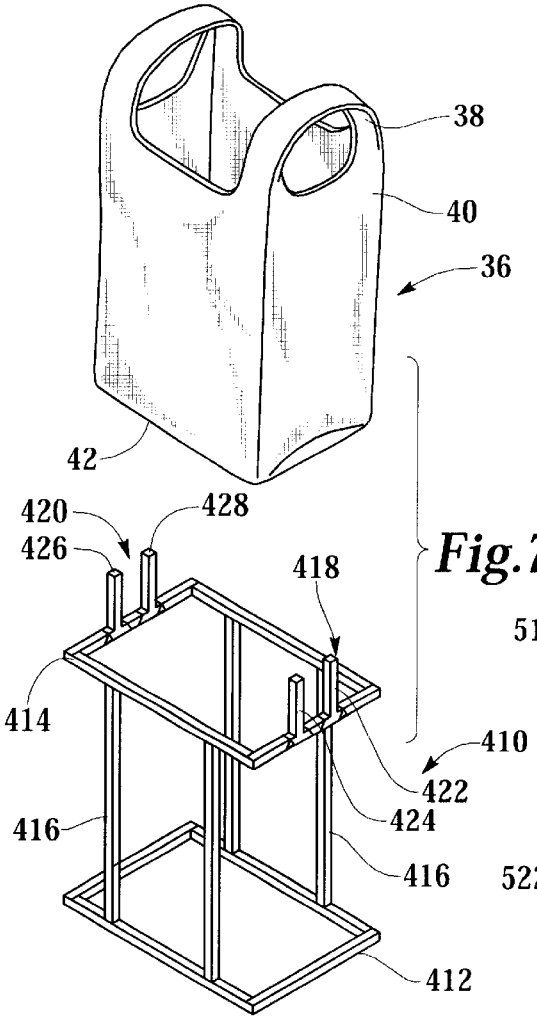
FIG. 7 is a plan view of another embodiment of a plastic grocery bag holder of the present invention and a plastic grocery bag to be disposed therein.

Referring now to FIG. 7, another embodiment of a holder for receiving a grocery bag and maintaining the bag in an upright open position is depicted and generally designated 410. Holder 410 includes a base frame 412 and an upper frame 414. Holder 410 includes four upwardly projecting support members 416 that extend between base frame 412 and upper frame 414 to support upper frame 414. Rotatably positioned upon upper frame 414 is a pair of handle receiving members 418, 420. Handle receiving members 418, 420 are rotatable between a vertical position, for receiving plastic bag 36 into and removing plastic bag 36 from holder 410, and a position wherein handle receiving members 418, 420 are rotated a predetermined angle from vertical to secure plastic bag 36 within holder 410. More specifically, handle receiving member 418 includes a pair of rotatable arms 422, 424 and handle receiving member 420 includes a pair of rotatable arms 426, 428. As will be explained in more detail below, as rotatable arms 422, 424 of handle receiving member 418 are rotated from vertical, the distance between rotatable arm 422 and rotatable arm 424 increases. Likewise, as rotatable arms 426, 428 of handle receiving member 420 are rotated from vertical, the distance between rotatable arm 426 and rotatable arm 428 increases. This allows the user of holder 410 to not only easily place handles 38 of bag 36 over handle receiving members 418, 420 but also allows the user to stretch handles 38 of bag 36 as rotatable arms 422, 424 of handle receiving member 418 and rotatable arms 426, 428 of handle receiving member 420 are rotated from vertical. As such, bag 36 is tightly secured in place when holder 410 is supporting bag 36. In addition, handle receiving members 418, 420 allow for ease in attaching and removing bag 36 from holder 410.

Figure 8:
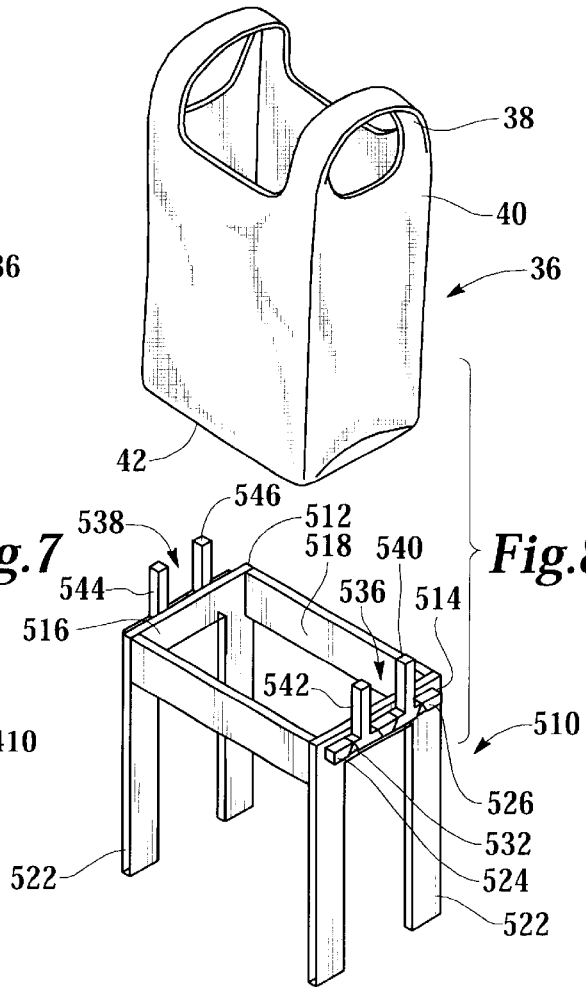
FIG. 8 is a plan view of another embodiment of a plastic grocery bag holder of the present invention and a plastic grocery bag to be disposed therein.

In FIG. 8, another embodiment of a holder for supporting a plastic bag in an upright and open position is depicted and generally designated 510. Holder 510 includes an upper frame 512 that consists of a pair of side panels 514, 516, a rear panel 518 and a front panel 520. Rear panel 518 is attached to side panels 514, 516 at their respective vertical edges. Similarly, front panel front 520 is attached to side panels 514, 516 at their respective vertical edges. Holder 510 also includes four upwardly projecting legs 522 that attach to the lower horizontal edge of side panels 514, 516. The lower surfaces of legs 522 provide a base for holder 510. Even though legs 522 are depicted as extending from side panels 514, 516, it should be understood by one skilled in the art that legs 522 may alternatively extend from front panel 520 and rear panel 518.

Upper frame 512 includes a pair of support members 524, 526 outwardly extending from side panel 514 and a similar pair of support members (not pictured) outwardly extending from side panel 516. Extending between support members 524, 526 is rod 532. Handle receiving member 536 is rotatably mounted on rod 532. Similarly, a rod extends between the support members of side panel 516 such that handle receiving member 538 is rotatable thereabout. Handle receiving members 536, 538 operate in a manner similar to that of handle receiving members 418, 420 of FIG. 4. Specifically, handle receiving member 536 includes a pair of rotatable arms 540, 542 and handle receiving member 538 includes a pair of rotatable arms 544, 546. As will be explained in more detail below, as rotatable arms 540, 542 of handle receiving member 536 are rotated from vertical, the distance between rotatable arm 540 and rotatable arm 542 increases. Likewise, as rotatable arms 544, 546 of handle receiving member 538 are rotated from vertical, the distance between rotatable arm 544 and rotatable arm 546 increases.

Figure 9A:
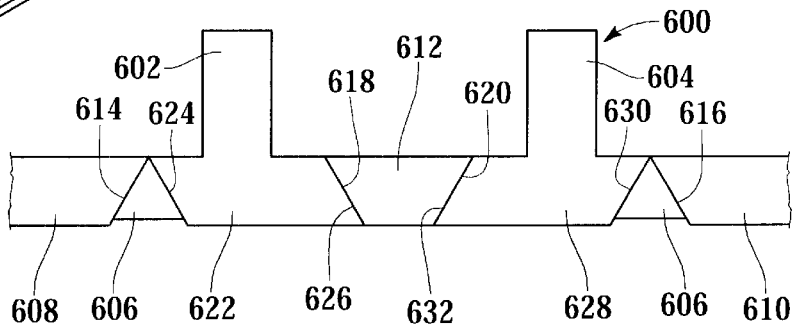
FIGS. 9A and 9B are an enlarged view of the operation of handle receiving members for a plastic grocery bag holder of the present invention.
Figure 9B:
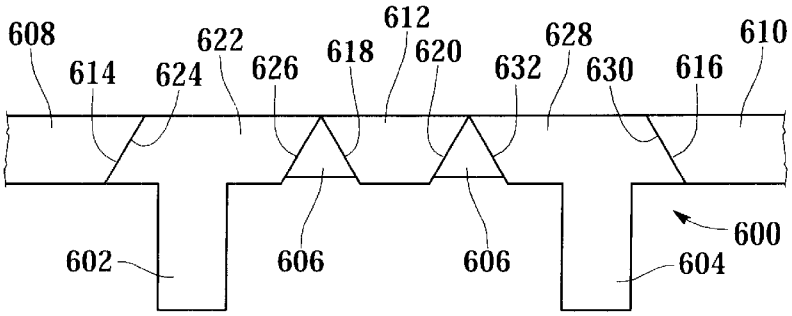

Referring now to FIGS. 9A–9B, therein is depicted a detailed view of the operation of a handle receiving member 600. Handle receiving member 600 is similar to handle receiving members 418, 420 of FIG. 7 and handle receiving members 536, 538 of FIG. 8. Handle receiving member 600 includes a pair of rotatable arms 602, 604. In the illustrated embodiment, rotatable arms 602, 604 may rotate independently of one another but it should be understood by those skilled in the art that a pair of rotating handles could alternatively rotate together without departing from the principles of the present invention. Rotatable arms 602, 604 rotate about an inner member 606. Inner member 606 is disposed within and fixably attached to end sections 608, 610 and center section 612. End sections 608, 610 may serve as part of upper frame 414 as seen in FIG. 7 or may be part of support members 524, 526 as seen in FIG. 8. In either case, end sections 608, 610, center section 612 and inner member 606 each have a generally circular cross section. End section 608 has an inner surface 614 that is cut at an angle relative to the vertical. Likewise, end section 610 has an inner surface 616 that is cut at an angle relative to the vertical. In an similar manner, outer surfaces 618, 620 of center section 612 are cut at angles relative to the vertical. As illustrated, the angle of inner surface 614 is equal to but opposite of the angle of outer surface 618. Likewise, the angle of inner surface 616 is equal to but opposite of the angle of outer surface 620. Preferably, these angle are 45 degrees.

Rotatable arm 602 has a base portion 622 that has a generally circular cross section. The outer surface 624 and the inner surface 626 of base portion 622 are each cut at the same angle relative to the vertical. Rotatable arm 604 has a base portion 628 that has a generally circular cross section. The outer surface 630 and the inner surface 632 of base portion 628 are each cut at the same angle relative to the vertical.

In operation, when rotatable arms 602, 604 are in the upwardly directed vertical position, as seen in FIG. 9A, the distance between rotatable arms 602, 604 is at a minimum. This allows the user of a holder utilizing handle receiving member 600 to place the handles of a bag around rotatable arms 602, 604 without having to stretch the bag. Once the handles of the bag are in place around rotatable arms 602, 604, then rotatable arms 602, 604 may be rotated about inner member 606 a predetermined angle from vertical. As rotatable arms 602, 604 rotate, the interaction between the angled surfaces outwardly shifts rotatable arms 602, 604. Specifically, the interaction of surface 618 and surface 626 outwardly shifts rotatable arm 602. In a like manner, the interaction between surface 620 and surface 632 outwardly shifts rotatable arm 604. Thus, the rotational motion of rotatable arms 602, 604 relative to inner member 606 also creates translational motion of rotatable arms 602, 604 relative to inner member 606 relative to each other. In the configuration seen in FIG. 9B, the distance between rotatable arms 602, 604 is at a maximum. This outward movement of rotatable arms 602, 604 allows the user to stretch the handles of the bag such that the bag is secured within a holder utilizing handle receiving member 600.

When the user desires to remove the bag from the holder, the user reverses the rotation of rotatable arms 602, 604. This reverse rotation creates interaction between the angled surfaces inwardly shifting rotatable arms 602, 604. Specifically, the interaction of surface 614 and surface 624 inwardly shifts rotatable arm 602. In a like manner, the interaction between surface 616 and surface 630 inwardly shifts rotatable arm 604. In this configuration, as seen in FIG. 9A, the distance between rotatable arms 602, 604 is again at a minimum. This allow the user to remove the handles of the bag from the holder utilizing handle receiving member 600 without having to stretch the bag.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for holding in an upright and open position, a plastic bag having a pair of handles, the apparatus comprising:

a base;

an upper frame;

at least one vertical support member extending between the base and the upper frame; and a pair of handle receiving members mounted to the upper frame for disposition within the handles of the plastic bag each pair of handle receiving members including a pair of rotatable arms, the rotatable arms having a first position and a second position, in the first position, the rotatable arms are generally vertical for receiving and removing the plastic bag, in the second position, the rotatable arms are rotated a predetermined angle from vertical for securing the plastic bag within the apparatus, the rotation of the rotatable arms from the first to the second position creating translational movement of the rotatable arms such that the distance between the rotatable arms in each pair of rotatable arms is greater in the second position than in the first position, thereby holding the plastic bag in an upright and open position.

2. The apparatus as recited in claim 1 wherein the base is a horizontally disposed bottom wall.

3. The apparatus as recited in claim 1 wherein the at least one vertical support member further comprises a pair of side walls, a front wall and a rear wall.

4. The apparatus as recited in claim 1 wherein the at least one vertical support member further comprises two pairs of generally symmetrically arranged legs.

5. The apparatus as recited in claim 4 wherein the base further comprises the bottom surfaces of the legs.

6. The apparatus as recited in claim 1 wherein the base further comprises a base frame.

7. The apparatus as recited in claim 1 wherein each of the handles of the plastic bag are not stretched when the rotatable arms are in the first position and are stretched when the rotatable arms are in the second position.

8. The apparatus as recited in claim 1 wherein each of the rotatable arms rotates independently of one another.

9. An apparatus for holding in an upright and open position, a plastic bag having a pair of handles, the apparatus comprising a base, an upper frame, at least one vertical support member extending between the base and the upper frame and a pair of handle receiving members mounted to the upper frame for disposition within the handles of the plastic bag each pair of handle receiving members including a pair of independently rotatable arms, the rotatable arms having a first position and a second position, in the first position, the rotatable arms are generally vertical for receiving and removing the plastic bag, in the second position, the rotatable arms are rotated a predetermined angle from vertical for securing the plastic bag within the apparatus, the rotation of the rotatable arms from the first to the second position creating translational movement of the rotatable arms such that the distance between the rotatable arms in each pair of rotatable arms is greater in the second position than in the first position and such that the rotatable arms stretch the handles of the plastic bag in the second position, thereby holding the plastic bag in an upright and open position.

10. The apparatus as recited in claim 9 wherein the base is a horizontally disposed bottom wall.

11. The apparatus as recited in claim 9 wherein at least one vertical support member further comprises a pair of side walls, a front wall and a rear wall.

12. The apparatus as recited in claim 9 wherein at least one vertical support member further comprises two pair of generally symmetrically arranged legs.

13. The apparatus as recited in claim 12 wherein the base further comprises the bottom surfaces of the legs.

14. An apparatus for holding in an upright and open position, a plastic bag having a pair of handles, the apparatus having a base, an upper frame and at least one vertical support member extending between the base and the upper frame, the apparatus comprising:

a pair of handle receiving members mounted to the upper frame for disposition within the handles of the plastic bag each pair of handle receiving members including a pair of rotatable arms, the rotatable arms having a first position and a second position, in the first position, the rotatable arms are generally vertical for receiving and removing the plastic bag, in the second position, the rotatable arms are rotated a predetermined angle from vertical for securing the plastic bag within the apparatus, the rotation of the rotatable arms from the first to the second position creating translational movement of the rotatable arms such that the distance between the rotatable arms in each pair of rotatable arms is greater in the second position than in the first position, thereby holding the plastic bag in an upright and open position.

* * * * *